US007161145B2

(12) United States Patent
Oser et al.

(10) Patent No.: US 7,161,145 B2
(45) Date of Patent: Jan. 9, 2007

(54) METHOD AND APPARATUS FOR THE DETECTION AND IDENTIFICATION OF TRACE ORGANIC SUBSTANCES FROM A CONTINUOUS FLOW SAMPLE SYSTEM USING LASER PHOTOIONIZATION-MASS SPECTROMETRY

(75) Inventors: Harald Oser, Menlo Park, CA (US); Michael J. Coggiola, Sunnyvale, CA (US); Steven E. Young, Mountain View, CA (US); Grace F. Chou, Mountain View, CA (US)

(73) Assignee: SRI International, Menlo Park, CA (US)

( * ) Notice: Subject to any disclaimer, the term of this patent is extended or adjusted under 35 U.S.C. 154(b) by 70 days.

(21) Appl. No.: 11/111,491

(22) Filed: Apr. 20, 2005

(65) Prior Publication Data

US 2005/0236565 A1 Oct. 27, 2005

Related U.S. Application Data

(60) Provisional application No. 60/564,087, filed on Apr. 21, 2004.

(51) Int. Cl.
*H01J 49/10* (2006.01)

(52) U.S. Cl. ..... 250/288; 250/282; 250/423 P

(58) Field of Classification Search ..... None
See application file for complete search history.

(56) References Cited

U.S. PATENT DOCUMENTS 4,820,648 A * 4/1989 Caprioli et al. ..... 250/288
5,397,895 A * 3/1995 Leone et al. ..... 250/288
2004/0149903 A1* 8/2004 Wang ..... 250/292

OTHER PUBLICATIONS

Harald Oser, et al., Development of a jet-REMPI (resonantly enhanced multiphoton ionization) continuous monitor for environmental applications, *Applied Optics*, vol. 40, No. 6, (Feb. 2001), pp. 859-865.

David M. Lubman, et al., "Resonant Two-Photon Ionization Spectroscopy of Biological Molecules in Supersonic Jets Volatilized by Pulsed Laser Desorption", (Oxford University Press, new York, 1990), pp. 353-382.

Raimo A. Ketola, et al., "Environmental applications of membrane introduction mass spectrometry", *J. Mass Spectrom.* 2002, 37: pp. 457-476.

Scott Bauer, et al., "Determination of Volatile Organic Compounds at the Parts per Trillion Level in Complex Aqueous Matrices Using Membrane Introduction Mass Spectrometry", *Anal. Chem.*, 1994, 66, pp. 4422-4431.

John Rydzewski, et al., "Undetectable TOC in UPW Can Influence DUV Photolithography Processes", proceedings of SPWCC (Semiconductor Pure Water and Chemicals Conference) 2002.

(Continued)

*Primary Examiner*—Jack I. Berman
(74) *Attorney, Agent, or Firm*—Beyer Weaver & Thomas LLP.

(57) ABSTRACT

A method and apparatus are provided for identifying analytes at low concentrations in a liquid sample. The liquid sample is introduced through a continuous flow membrane inlet system. The analytes that permeate the membrane are analyzed by photoionization-time-of-flight mass spectrometry. The analytes remaining in the liquid sample that do not permeate the membrane are conducted to a capillary tube inlet that introduces the liquid sample and other analytes as droplets into the photoionization zone. Any analytes remaining absorbed or adsorbed on the membrane are driven through the membrane by application of heat. Analytes may be analyzed by either resonance enhanced multiphoton ionization (REMPI) or single photon ionization (SPI), both of which are provided in the apparatus and can be selected as alternative sources.

33 Claims, 6 Drawing Sheets

OTHER PUBLICATIONS

Richard Godec, The Performance Comparison of Ultrapure Water TOC Analyzers using an Automated Standard Addition Apparatus, proceedings of the Semiconductor Pure Water and Chemicals Conference, Santa Clara, Calif., pp. 61-112 (Mar. 13-16, 2000).

John Rydzewski, Identification of Criticalcontaminants by Applying an Understanding of Different TOC Measuring Technologies, Ultrapure, Water, Feb. 2002 (UP190220), pp. 20-26.

Harald Oser, et al., "Developmental of a Laser Ionization Mass Spectrometer for the Rapid Detection of Aromatic Hydrocarbons in Aqueous Samples", Organohalogen Compounds—vol. 66 (Sep. 2004), pp. 766-771.

Anurag Kumar, et al., "Identifying organic contaminants in ultrapure water at sub-parts-per-billion levels", (Jan. 2002); http://www.micromagazine.com/archive/00/01/kumar.html.

* cited by examiner

METHOD AND APPARATUS FOR THE DETECTION AND IDENTIFICATION OF TRACE ORGANIC SUBSTANCES FROM A CONTINUOUS FLOW SAMPLE SYSTEM USING LASER PHOTOIONIZATION-MASS SPECTROMETRY

CLAIM OF PRIORITY

Priority is hereby claimed under 35 U.S.C. §119(e) from U.S. Provisional Patent Application No. 60/564,087, filed on Apr. 21, 2004, by Oser, et al. and entitled, "METHOD AND APPARATUS FOR THE DETECTION AND IDENTIFICATION OF TRACE ORGANIC SUBSTANCES FROM A CONTINUOUS FLOW SAMPLE SYSTEM USING LASER PHOTOIONIZATION-TIME-OF-FLIGHT MASS SPECTROMETRY," which is incorporated by reference for all purposes.

BACKGROUND OF THE INVENTION

The apparatus and method of the invention utilize a two-photon resonance-enhanced multiphoton ionization (REMPI) instrument for trace species analysis. The invention is directed to a method and apparatus for utilizing a continuous flow of a liquid sample to detect and to identify trace organic substances in the sample. As REMPI is fundamentally a gas phase method the invention combines REMPI with membrane introduction mass spectrometry (MIMS), whereby organic compounds are extracted into the gas phase from a polar solvent such as water. A significant feature of MIMS is the simultaneous introduction of all organic analytes into the mass spectrometer. In many MIMS applications, the mass spectrometer is a standard quadrupole instrument, although both ion traps and triple quadrupole devices have also been used. Most of the studies using MIMS utilize electron impact or chemical ionization. However, the application of conventional ionization methods such as electron impact can make analysis of complex mixtures more difficult due to extensive molecular fragmentation. Accordingly, the invention combines MIMS with REMPI as the laser photoionization method, the latter of which may be adjusted so as not to produce photofragmentation. The combination of MIMS and REMPI provides sensitive and rapid analysis without prior separation or sample preparation and without deconvolution of multiple mass peaks.

While many of the analytes of interest which pass through the membrane to the photoionization zone may be photoionized using REMPI, there remains in the liquid sample analytes which either do not pass through the membrane. In particular, there may be analytes which are retained within the liquid sample flowing past the membrane that remain in solution. As a further embodiment, the liquid sample, after contact with the membrane, may be introduced into a capillary inlet tube which directs the liquid sample as droplets to the photoionization zone at subatmospheric pressure. Analytes in these droplets may be photoionized by REMPI.

As a further embodiment, it is realized that not all of the analytes, particularly the analytes which are not permeable to the membrane, may be readily photoionized by REMPI. Accordingly, both a radiation source for performing REMPI and a second source of radiation for performing single photon ionization (SPI) are provided. The two sources of radiation are selectively directed to the photoionization zone by a system of reflecting surfaces so that radiation from either source may be selected.

As yet another embodiment of the invention, there is a third source of analytes from the liquid sample, that is, compounds that are adsorbed or absorbed onto and into the membrane, but which do not pass through the membrane at the sampling temperature. Subsequent to photoionization and mass spectrometrical analysis of the other analytes, the analytes adsorbed/absorbed onto or into the membrane may be released therefrom by applying heat to the membrane or by running a different solvent to the membrane. This latter process would require halting the continuous flow of sample to the membrane, so it is preferred that heat be applied. These analytes will then pass through the membrane into the photoionization zone where they may be analyzed by REMPI or single photon ionization, as appropriate.

The present method and apparatus are applicable for detecting and identifying organic compounds in water samples without interference from the bulk water solvent. Thus, water samples such as ultrapure water for semiconductor processing, ground water, surface water, biological fluids, and potable water may be analyzed in real time for the presence of volatile organic compounds (VOCs), such as benzene, toluene, and xylene; for explosives, nitro compounds, organic molecules containing halogen, inorganic compounds such as metal and heavy atoms, aromatic ketones, large biomolecules, and the like. Because of their short-lived excited states, such molecules often cannot be detected using conventional nanosecond pulse-duration laser ionization sources. Typical detection ranges for the method according to the present invention using either the membrane or capillary inlet systems are in the range of about 1 ppb to about 1 ppt and the range of about 1 ppb to about 1 ppm of analyte in a sample.

Since sample preparation is not required, location of the apparatus need not be confined to a laboratory. A compact and portable analytical unit for sensitive and selective detection, identification, and quantification of trace organic chemicals and toxic compounds in water is provided by the invention.

SUMMARY OF THE INVENTION

A method is provided for identifying analytes at low concentration in a liquid sample by mass spectrometry comprising the steps of a) introducing a liquid sample containing a solvent and analytes to a membrane impermeable to the solvent whereby at least a portion of the analytes permeate the membrane;

b) directing the analytes that permeate said membrane into a zone of photoionization in which the analytes are ionized by resonance enhanced multiphoton ionization or by single photon ionization to form analyte ions;

c) passing the analyte ions from step (b) into a mass analyzer of a mass spectrometer for mass analysis of the ions;

d) directing the portion of the liquid sample impermeable to the membrane containing other analytes not retained on the membrane into a capillary tube whereby the liquid sample and other analytes from the membrane are introduced to the zone of ionization;

e) ionizing the other analytes from step (d) by resonance enhanced multiphoton ionization or by single photon ionization to form analyte ions;

f) passing the analyte ions from step (e) into a mass analyzer of a mass spectrometer for mass analysis of the ions;

g) optionally, applying heat to the membrane to drive any analytes retained on the membrane through the membrane into the zone of photoionization in which the analytes are ionized by resonance enhanced multiphoton ionization or by single photon ionization to form analyte ions;

h) optionally passing analyte ions from step (g) into a mass analyzer of a mass spectrometer for mass analysis of the ions.

A method is provided for identifying analytes at low concentration in a liquid sample by mass spectrometry comprising the steps of a) introducing a liquid sample containing solvent and analytes to a membrane impermeable to the solvent whereby at least a portion of the analytes permeate the membrane;

b) directing the analytes that permeate the membrane into a zone of photoionization in which the analytes are ionized by resonance enhanced multiphoton ionization at 266 nm to form analyte ions; and c) passing the analyte ions into a mass analyzer of a mass spectrometer for mass analysis of the ions.

An apparatus is provided for identifying analytes at low concentration in a liquid sample by mass spectrometry comprising a zone of ionization for ionizing gaseous or liquid analytes; a membrane impermeable to the solvent and permeable to at least a portion of analytes contained in the liquid sample, whereby the permeable analytes are deliverable to the zone of ionization; a capillary tube adapted for receiving the portion of the liquid sample impermeable to the membrane containing other analytes not retained on the membrane, the tube directed to introduce the liquid sample and other analytes from the membrane to the zone of ionization; a first source for providing radiation for performing resonance enhanced multiphoton ionization of the analytes; a second source for providing radiation for performing single photon ionization of the analytes; a system of reflecting surfaces for selectively directing radiation either from the first source or the second source to the zone of ionization; a mass spectrometer for determining the m/e ratio of ions formed in the zone.

The apparatus may further comprise a component for driving analytes initially retained on the membrane through the membrane into the zone of ionization.

An apparatus is provided for identifying analytes at low concentration in a liquid sample by mass spectrometry comprising a membrane impermeable to the solvent and permeable to at least a portion of analytes contained in the liquid sample; a zone of photoionization for analytes passing through the membrane; a source for irradiating the zone for performing resonance enhanced multiphoton ionization of the analytes; a mass spectrometer for determining the m/e ratio of ions formed in the zone.

An apparatus is provided for introducing analytes from a liquid sample into an ionization zone for analysis by mass spectrometry comprising a membrane impermeable to the solvent and permeable to at least a portion of analytes contained in a polar liquid sample, the permeable analytes being capable of delivered to a zone of ionization; a capillary tube adapted for receiving the portion of the liquid sample impermeable to the membrane containing other analytes not retained on the membrane, the tube capable of introducing the liquid sample and other analytes from the membrane to the zone of ionization.

An apparatus is also provided for photoionizing analytes for analysis by mass spectrometry comprising a) a zone of photoionization for ionizing gaseous or liquid analytes;

b) a first source for providing radiation for performing resonance enhanced multiphoton ionization of the analytes;

c) a second source for providing radiation for performing single photon ionization of the analytes;

d) a system of reflecting surfaces for selectively directing radiation either from the first source or the second source to the zone of photoionization.

The liquid sample may comprise ultrapure water for semiconductor processing containing trace organic compounds, potable water, or any aqueous sample containing organic contaminants in trace amounts.

DETAILED DESCRIPTION

Figure 1:
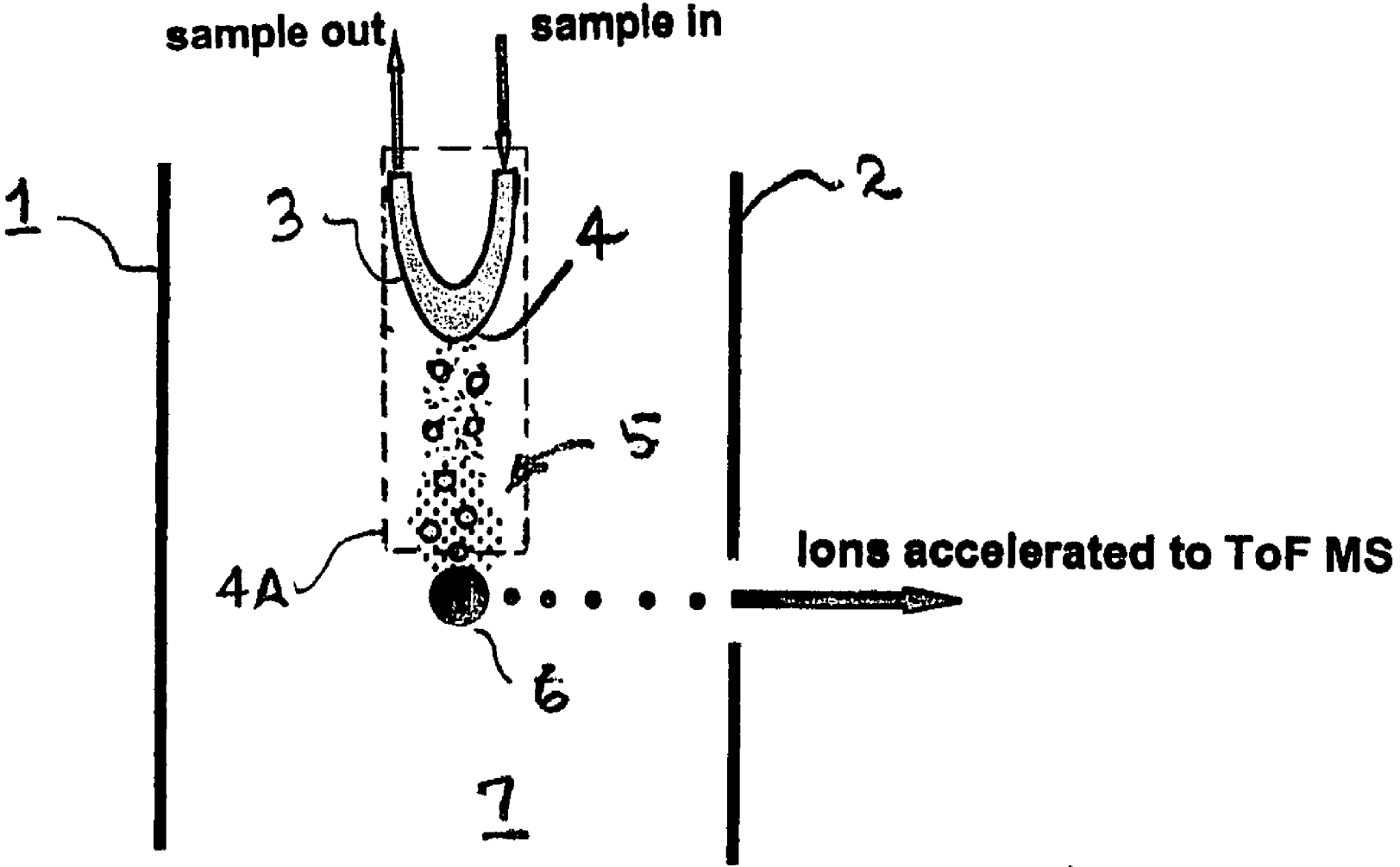
FIG. 1 is a schematic diagram of a membrane based water inlet system for introducing analytes from a liquid sample through a membrane into a photoionization zone.

The present invention provides an apparatus comprising a membrane inlet system that uses a selective permeability membrane to admit organic compounds and reject water and other polar solvents, and a photoionization source to photoionize the compounds to be analyzed by residence enhanced multi photon ionization and time-of-flight mass spectrometry. These components may be utilized as a compact and portable analytical instrument since there is no requirement for sample preparation and the equipment need not be confined to a laboratory. Referring to FIG. 1, there is shown an example of an inlet portion of an apparatus according to the present invention. The membrane introduction device consists of a flow injection module 3 and a membrane tip 4. The module 3 and tip 4 are surrounded by a tubular guide 4A of non-conducting material to more precisely direct the vaporized analytes to beam 6. The sample analyte containing solution is injected into the flow injection module 3 which maintains a constant flow of the liquid sample through the membrane tube. As the analyte solution passes across the inner surface of the membrane, the analytes 5 diffuse through the membrane and evaporate into the ionization chamber 7 guided by guide 4A. Guide 4A is shown in ghost in order to show module 3 and tip 4. Altering the temperature of the water flow can control the speed of introduction of the sample into the ionization chamber. As the temperatures increase, the analyte compound diffuses faster through the membrane, increasing the speed of the measurement. However, if water is the solvent in the liquid sample, temperature should be maintained below 100° C. The analytes 5 that diffuse through the membrane are presented by guide 4A to the photoionization beam 6 which selectively photoionizes the selected analytes. The ions are accelerated by way of the ion source repeller electrode 1 and the ion source extraction electrode 2 through an orifice into a time-of-flight mass spectrometer.

The type of membrane can be varied by those of ordinary skill in the art depending upon the types of molecules that are of interest to be studied or analyzed. Each membrane rejects different compounds, thus allowing for the deduction of a wide variety of molecules. Membranes may be selected which allow for the selective fusion of the analyte of interest preferentially over the aqueous matrix or other possible interfering compounds. This separation at the sample inlet enhances the sensitivity of the instrument.

Typical membrane temperatures are between about 50° C. and 80° C. At higher temperatures, more sample passes through the membrane into the ion source of the mass spectrometer, which may result in higher sensitivity. However, as more water also diffuses through the membrane at higher temperatures, this increases the background pressure in the ion source and could lead to deteriorated performance of the detection system. However, by using selective photoionization, background components such as water with a relatively high ionization potential are not ionized.

A preferred membrane material is silicone, which tends to exclude polar molecules since polar molecules are not soluble in silicone and therefore not absorbed on the membrane surface. Higher molecular weight species tend to adhere to the surface of the membrane and do not evaporate into the vacuum space of the photoionization chamber. An advantage of the membrane inlet system is that the membranes may be easily replaced and this allows for the examination of alternative materials and membrane geometries, such as thinner walled membranes.

Figure 2:
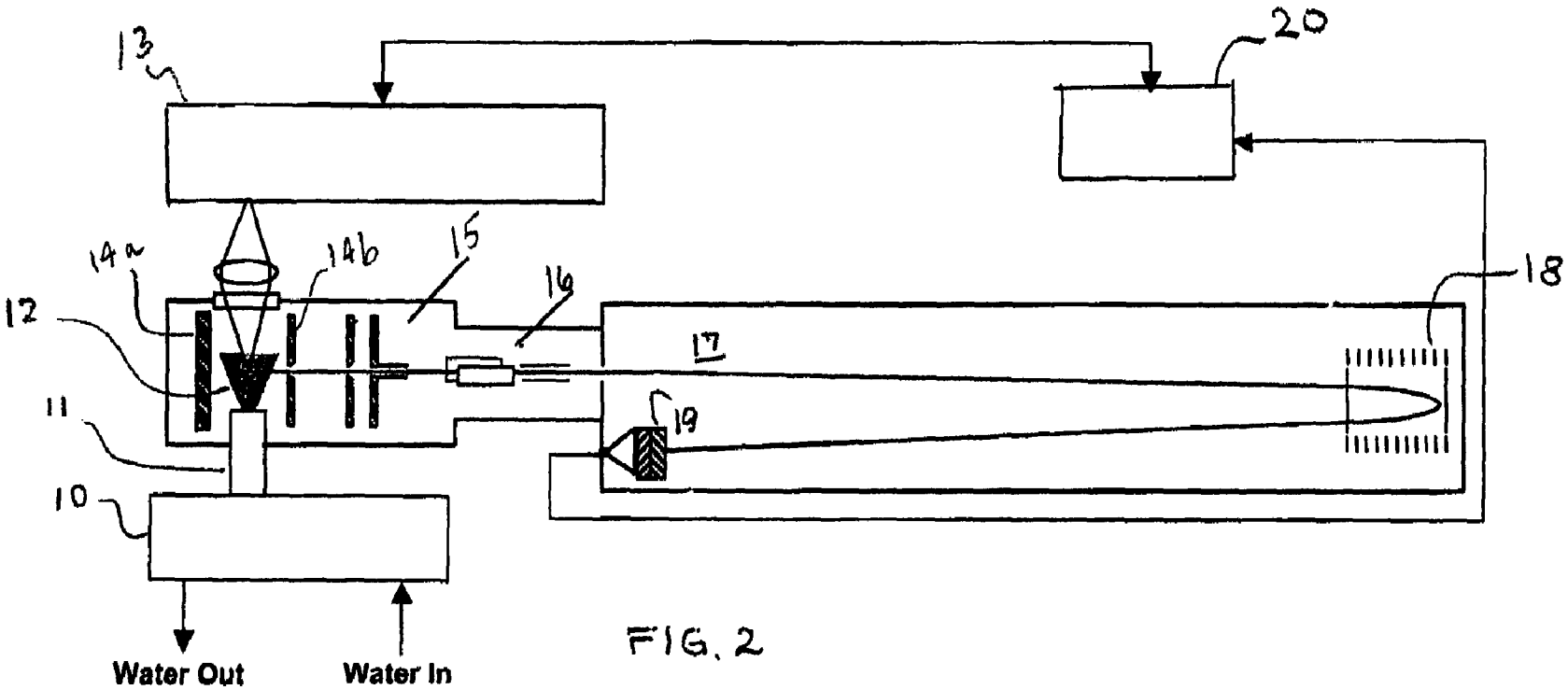
FIG. 2 is a schematic diagram of an apparatus according to the present invention housing a membrane based water sampler that separates analytes from a water sample for introduction into a photoionizaiton zone and components to analyze the analytes.

Referring to FIG. 2, there is shown an apparatus comprising the membrane based water sampler, a photoionization source and a time-of-flight mass spectrometer. A REMPI source laser 13 is used to provide the radiation for photoionization of the analytes. Preferably, a two photon REMPI process laser is used whose frequency is resonant with an electronic transition of the target molecule, followed by a second photon which ionizes the molecule during the few nanoseconds or shorter residence time in its excited electronic state. Particularly suited for REMPI detection are the organic species that contain an aromatic ring, a chromophore which absorbs in the ultraviolet region between about 200 and 350 nm. Referring again to FIG. 2, the apparatus comprises a continuous water flow inlet 10 which can continuously receive a water sample. The sample is contacted with a membrane based water inlet system 11 such as that shown in FIG. 1, from which the analytes which permeate the membrane, are introduced into the photoionization zone 12. It should be made of non-conducting material so as not to create field effects within the ionization zone. The photoionization radiation is appropriately focused from the photoionization laser 13 to the photoionization zone 12. The ions are accelerated from the photoionization zone by repeller and extraction electrodes 14A and 14B, respectively, through ion extraction optics 15 and ion beam steering plates 16 into the time-of-flight mass spectrometer 17. The ions are reflected from reflector 18 onto a detector 19 which sends its signals to a computer 20. In this way there can be a continuous flow of sample into the apparatus with real time monitoring of the analytes in the samples.

For analytes such as aromatic ring containing compounds, the resonant excitation step can operate close to optical saturation, so that a sizable fraction can be elevated to the excited state using REMPI. From the excited state, the ionization step is estimated to operate at between 10 and 100 percent efficiency, thus the overall yield can reach up to about 10 percent. This is several orders of magnitude better efficiency than typically found by using electron impact ionization apparatus. When operated at low to medium laser intensity, the REMPI process produces solely or primarily the parent molecular ion structure which greatly simplifies the interpretation of the mass spectrum because of lack of fragmentation.

Figure 3:
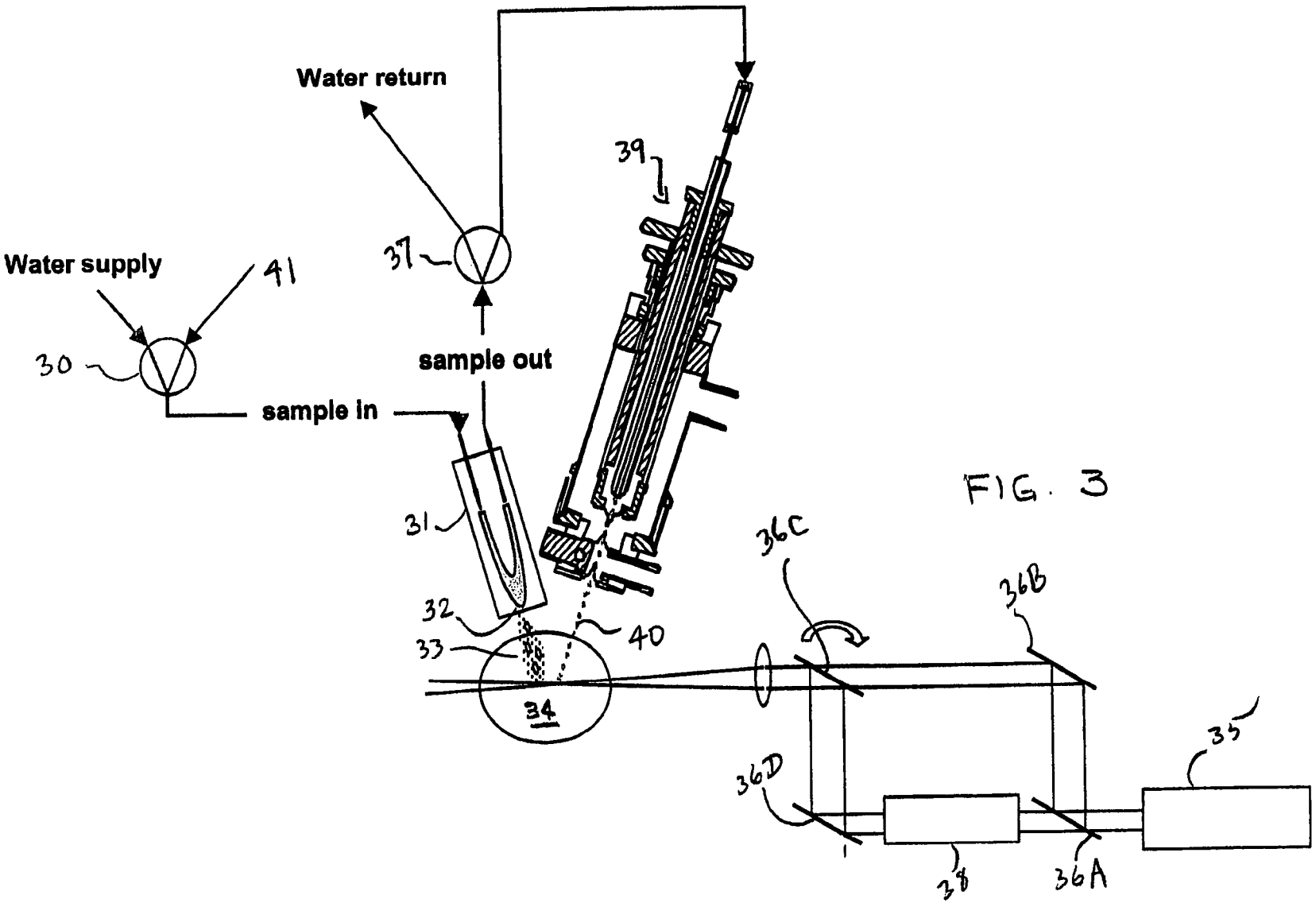
FIG. 3 is a schematic diagram of an apparatus according to the present invention having a membrane based water sampler, a direct liquid capillary probe for receiving analytes not permeable to the membrane and a system of radiation sources and reflecting surfaces for selectively focusing radiation for REMPI or SPI to the photoionization zone.

Referring to FIG. 3 there is shown an apparatus having both a membrane based water sampler inlet system and a direct liquid injection capillary probe. There is also shown a source for applying either REMPI or SPI radiation wavelengths to the photoionization zone. This is important in the event that some of the analytes do not have suitable excited states for REMPI application. In such instances, the analytes may be photoionized by single photoionization. The continuous flow water inlet 30 receives the water supply that directs the samples to the membrane probe 31. At the membrane tip 32 the analytes 33 that permeate the membrane are introduced to the photoionization zone 34. A variable or fixed wavelength laser 35 provides appropriate wavelengths for REMPI by being reflected to surfaces 36A and 36B, respectively, to the photoionization zone 34. A preferred wavelength for the laser is 266 nm.

Alternatively, a fixed wavelength from the laser may be extracted to provide single photoionization at the photoionization zone 34. In this case, the radiation is sent through a gas cell 38 to rectify the beam to the desired wavelength and then is reflected off surfaces 36D and 36C to the photoionization zone 34. A preferred wavelength for SPI is 118 nm. The surface 36C represents a moveable mirror whereby radiation reflected from 36B or 36D can be selectively directed to the photoionization zone 34. The REMPI and SPI radiation sources may be single or multiple lasers and the REMPI radiation may be provided from a different laser or set of lasers from the laser or set of lasers that provide the SPI radiation. One or more sources of radiation may also be provided such that along the path from the respective laser to the zone of ionization, the beam is tuned to result in either REMPI or SPI-suitable radiation.

The liquid sample, which is not absorbed/adsorbed in the membrane probe 31, exits the probe and is directed to a separator 37 which directs most of the water sample to the water return and takes a small sample to a direct liquid injection capillary probe 39. Separator 37 may be a differential pump that drives a portion of the sample to water return and portion to the probe 39. A capillary probe is described in published PCT Application WO 2004/097891-A3, published Nov. 11, 2004, which is incorporated by reference herein. The liquid sample is directed as fine droplets 40 to the photoionization zone 34 where they may be ionized by either REMPI or single photon ionization as described above.

The water sample at the continuous flow water inlet 30 may be heated, for example by a flow of heated air 41, to an appropriate temperature optimized for membrane permeability of the desired analytes. Also, the sample may be heated to a higher temperature to drive through any absorbed/adsorbed analytes on the membrane which were retained on the membrane but did not permeate the membrane at a lower sample temperature.

It is also considered to be within the scope of the present invention an apparatus for introducing analytes from a liquid sample into an ionization zone for analysis by mass spectrometry comprising a membrane impermeable to the solvent of the sample and permeable to at least a portion of the analytes contained in the sample; and a capillary tube adapted for receiving the portion of the liquid sample impermeable to the membrane containing other analytes not retained on the membrane. The capillary tube is capable of introducing the liquid sample and other analytes from the membrane to a zone of ionization.

Also within the scope of the invention is an apparatus for photoionizing analytes for analysis by mass spectrometry comprising:

a) a zone of photoionization for ionizing gaseous or liquid analytes;

b) a first source for providing radiation for performing resonance enhanced multiphoton ionization of the analytes;

c) a second source for providing radiation for performing single photon ionization of the analytes; and d) a system of reflecting surfaces for selectively directing radiation either from the first source or the second source to the zone of photoionization.

The first and second source of radiation may be the same source, i.e., the same laser, or they may be different sources, i.e., different lasers.

The apparatus according to the invention may be utilized to detect trace organic compounds in water sources such as ultrapure water for semiconductor processing, ground water, surface water, biological fluids and potable water. For example, contaminants found in ultrapure water may be due to the source of the water itself, for example, municipal water, from the water purification systems used to purify the water such as ion exchange resins, and from semiconductor processing chemicals found in reclaimed water. Such specific contaminants include but are not limited to, trimethylemine, benzene sulfonic acid, isopropyl alcohol, urea, glycidol, tetremethylammonium hydroxide (TMAH), 1-3 dichloro-2-propanol, and ethylene glycol. Other contaminants that may be found in various water sources are siloxanes, low molecular weight alcohols, organic nitrogen compounds, organic sulfur compounds, organic surfactants, organic acids, chlorinated or brominated hydrocarbons, phthalates and silicones. Ultrapure water is required not only in semiconductor manufacturing, but also in areas such as pharmaceuticals, biotechnology products, optoelectronic products, the food and beverage industry, the power industry (steam boilers), and the like.

The following examples are presented for purposes of illustration and are not intended to limit the invention in any way.

EXAMPLE 1

A membrane introduction device was obtained commercially from MIMS Technology (Palm Bay, Fla.), consisting of a flow injection module and a heated membrane tip. The device contained a membrane of pharmaceutical grade platinum-cured silicone tubing (HelixMark) manufactured with Dow Corning Silastic Q7-4750. The sample is loaded into the flow injection module which maintains a constant flow of water through the membrane tip. As the analyte solution passes across the inner surface of the membrane, the target organic molecules diffuse through the membrane and evaporate into a REMPI mass spectrometer ionization chamber. The temperature of the membrane is controlled by varying the temperature of the water flow. As the temperature is increased, the analyte diffusion rate through the membrane increases, thus reducing the measurement time. However, diffusion of organic compounds is hampered as the temperature reaches 100° C. due to formation of bubbles in the water. Tests were performed initially with the temperature varied between 30° C. and 90° C. in order to determine the minimum response time in combination with the most sensitive response.

Figure 4:
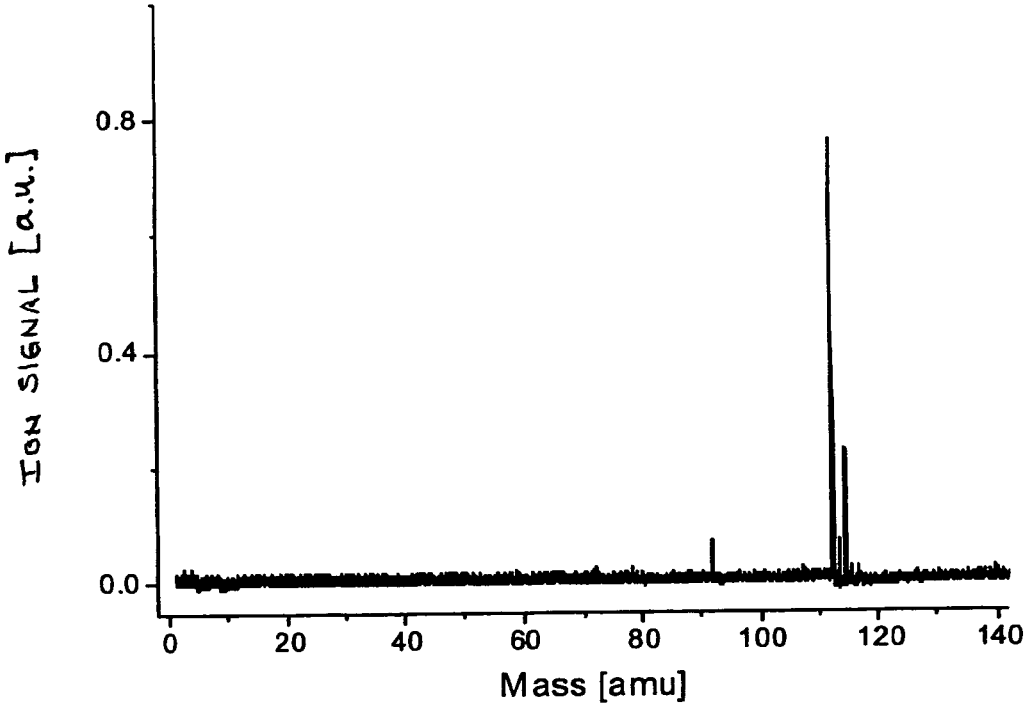
FIG. 4 is the mass spectrum of chlorobenzene in water after introduction into the ionization chamber through a membrane based inlet system.
Figure 5A:
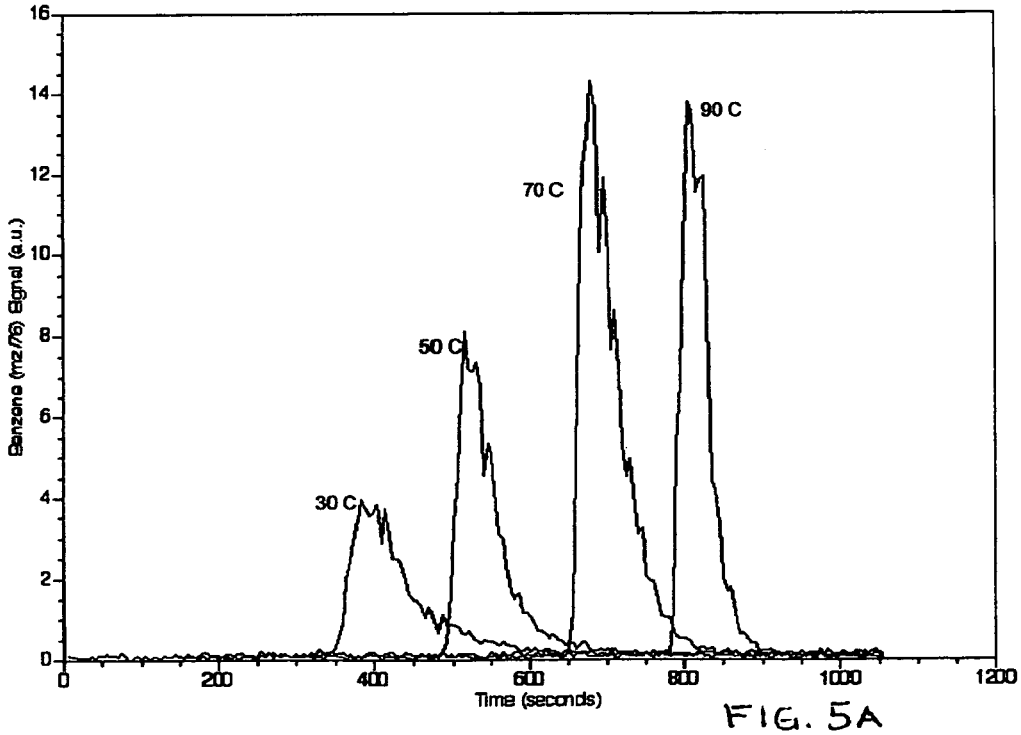
FIGS. 5A–5C are graphs of the temporal responses of mass spec signals for 10 ml injections into a membrane based inlet system-mass spectrometer at four different temperatures for benzene, toluene and xylene, respectively. Signals have been displaced horizontally for clarity.
Figure 5B:
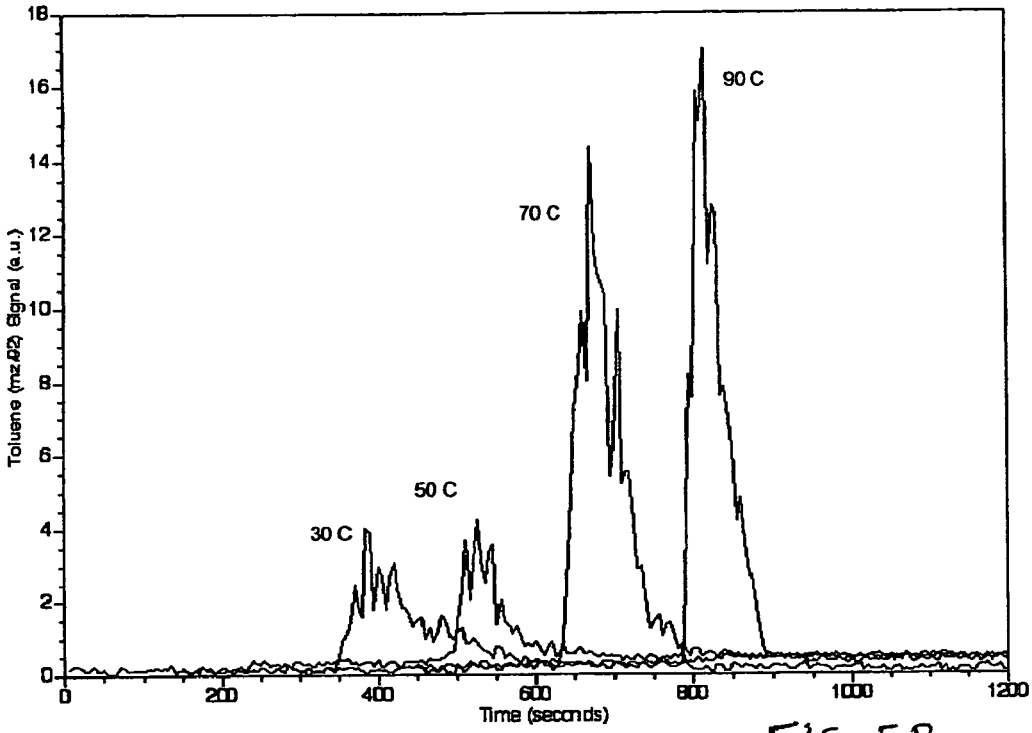
Figure 5C:
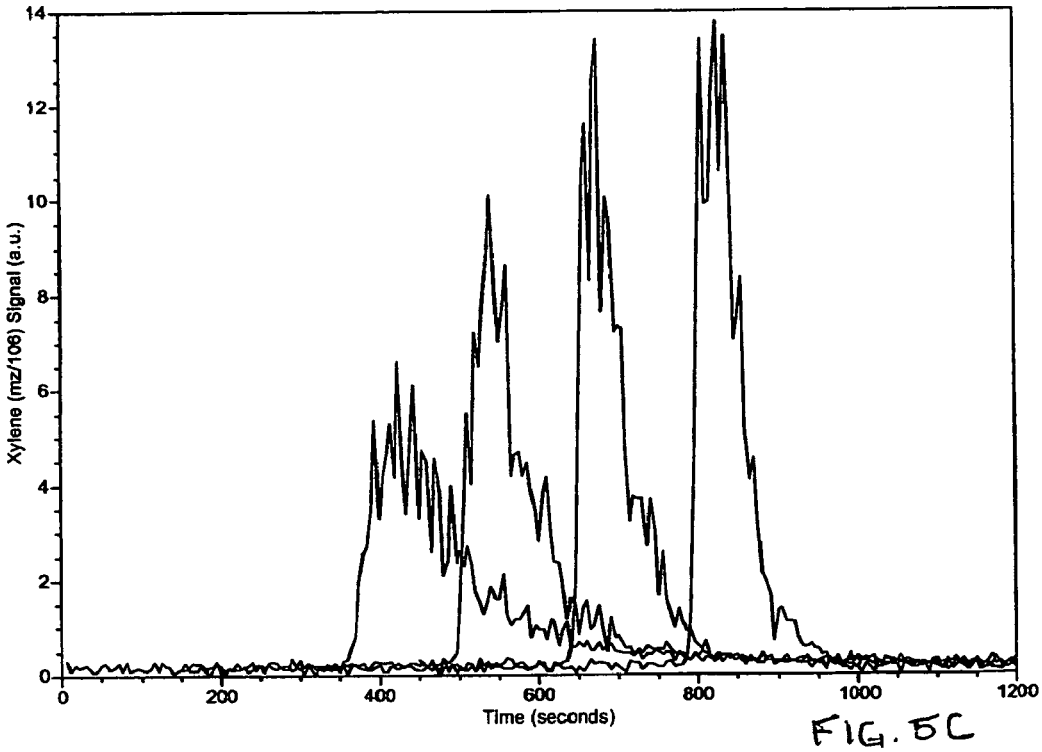

The membrane probe is inserted into the inlet of the vacuum chamber through a standard ½" probe lock, forming a vacuum-tight seal. The VOCs (volatile organic compounds) flow effusively into the vacuum chamber from the exit of the membrane tip which is approximately 2 cm from the laser ionization region. VOC molecules that cross the laser beam path are ionized, extracted using ion optics, and their mass analyzed by a time-of-flight mass spectrometer. A schematic of the laser photoionization mass spectrometer is shown in FIG. 2. The laser system used for ionization in these tests is the fourth harmonic output (266 nm) of a Nd:YAG laser system (Continuum Powerlite Precision 9010). The laser operates at a 10 Hz repetition rate with output energy at 266 nm of approximately 7 mJ/pulse and a pulse width of 5 ns. In order to have a constant and defined ionization volume, an iris is placed in front of the entrance window to the mass spectrometer chamber. The active beam area is 2 $mm^2$ and an ionization volume of ~10 $mm^3$ is maintained throughout the tests. The nascent ions are extracted and mass analyzed by a R. M. Jordan reflectron TOF-MS with a mass resolution of approximately 500. Two turbomolecular pumps (Varian Turbo V-250) maintain pressures in the ionization chamber and mass spectrometer regions of $10^{-5}$ Torr and $5\times10^{-7}$ Torr, respectively. The ion signals are amplified by an Ortec 9306 preamplifier with a gain of 85 and a 1 GHz bandwidth, and recorded using a 500 MHz Signatec DA500A digitizer. Signals are typically averaged for time periods between 1 and 5 seconds. In order to evaluate and characterize the combination of membrane based sample introduction and laser ionization TOF MS, deionized water (Millipore-RO4) was spiked with known concentrations of molecules from the BTX (benzene, toluene, ethyl benzene, xylene) family as well as chlorobenzene. One test of the MIMS-REMPI system was to determine its sensitivity in mass identification of the parent compounds with little or no fragmentation. FIG. 4 shows the mass spectrum obtained from a dilute solution of chlorobenzene in water. There is very little fragmentation of the parent compound, and the ratio of the mass signals at 112 amu and 114 amu reflects the 3:1 natural abundance of the chlorine isotopes. FIG. 4 is typical of results for the VOCs benzene, toluene and xylene and shows that the MIMS-REMPI system is capable of detecting the parent ion with a mass resolution similar to that observed in conventional gas-phase measurements. The time and temperature dependence of the observed signal for toluene were also investigated. The reservoir of the MIMS fluid injection system was filled with 2 liters of deionized water spiked with 2 ml of toluene to create a constant sample with 1 mL/L concentration. The MIMS was operated at four temperatures 30, 50, 70, and 90° C. and the ion intensity integrated for 1 second and recorded at 2 second intervals. Although the toluene concentration was very high, there appears to be considerable scatter in the data despite the fixed sample flow and analysis conditions. This variation is a consequence of the short, 1 -second, integration time corresponding to just 10 laser shots. Also, no attempt was made to correct the signal for shot-to-shot variations in the laser intensity. In view of this short averaging time, the m/z 92 signal corresponding to the parent molecular ion of toluene appears to be reasonably constant. The signal intensity does increase with increasing temperature as a result of the enhanced toluene permeation through the membrane material. The degree of increase, however, diminishes as the sample temperature approaches 90° C. To further characterize the response of the system, samples of benzene, toluene, and o-xylene at concentrations of 100 μL/L were prepared. 10 mL aliquots of these solutions were injected into the membrane inlet flow controller to observe the temporal response of the system. Measurements were again made at 30, 50, 70, and 90° C. for each compound and data were averaged over 10 laser pulses and recorded at 2 second intervals. The results are plotted as a function of time after injection for benzene, toluene, and o-xylene in FIGS. 5A, 5B, and 5C, respectively. The results for each temperature are shifted horizontally for clarity whereas the observed ion signals all commence at the same time after injection. It can be seen that the parent ion peak height increases while the full width at half maximum decreases as the temperature of the membrane system is raised. Table 1 presents the results in numerical form with the times measured from first onset of response for each compound at a fixed temperature. It was concluded from these results that an operating temperature of 80° C. was the optimum for this system, considering the balance between intensity, short cycle time (needed for cleanup of the water flow system), membrane life, and potential difficulties with air bubbles in the water.

TABLE 1

Summary of Temporal Response Width as a Function of Sample Temperature

| Analyte | Sample Temperature (deg C.) | FWHM (s) |
|---|---|---|
| Benzene | 30 | 72 |
| | 50 | 50 |
| | 70 | 53 |
| | 90 | 36 |
| Toluene | 30 | 58 |
| | 50 | 50 |
| | 70 | 56 |
| | 90 | 33 |
| Xylene | 30 | 103 |
| | 50 | 56 |
| | 70 | 53 |
| | 90 | 61 |

EXAMPLE 2

A second group of tests was conducted to evaluate reproducibility and limits of detection (LOD) for the membrane inlet/laser photoionization/mass spectrometer combination described in Example 1. For this purpose, sample concentrations of 10, 1.0, 0.1, 0.01 and 0.001 μL/L were prepared through serial dilution of benzene, chlorobenzene, and o-xylene in deionized water. Toluene was not used in these low concentration tests because of its residual background due to initial spiking at high levels in the reservoir. In these tests, the 2 L reservoir was filled with deionized water then spiked with 20 μL of benzene-$d_6$ to provide a constant reference at m/z 84 throughout the experiments. This reference compound permitted normalization of intensities of the analyte without concern for small changes in the operating characteristics of the combined membrane/laser/spectrometer system. To evaluate reproducibility, 10 mL of a 1.0 μL/L o-xylene solution was injected in the input of the flow injection controller and measurements made 1-second averaged peak signal intensities at 80° C. for both this compound and the deuterated benzene. The results are summarized in Table 2. The intensities are given in units that are arbitrary (volts) but the same for each peak. The absolute o-xylene intensity differs from the benzene-$d_6$ because of differences in the total ionization efficiency and permeability of the membrane for these two compounds. While there is a 19% standard deviation for deuterated benzene in these three runs, there is less than a 4% standard deviation for the o-xylene. The lower value is more characteristic of this system.

TABLE 2

Peak Signal Intensities for Triplicate 10 mL Injection of 1 ppm o-Xylene and Benzene-$d_6$

| | Benzene-$d_6$ Intensity (V) | Xylene Intensity (V) |
|---|---|---|
| Injection 1 | 1.15 | 0.52 |
| Injection 2 | 1.10 | 0.55 |
| Injection 3 | 0.80 | 0.55 |
| Average | 1.02 | 0.54 |

Figure 6:
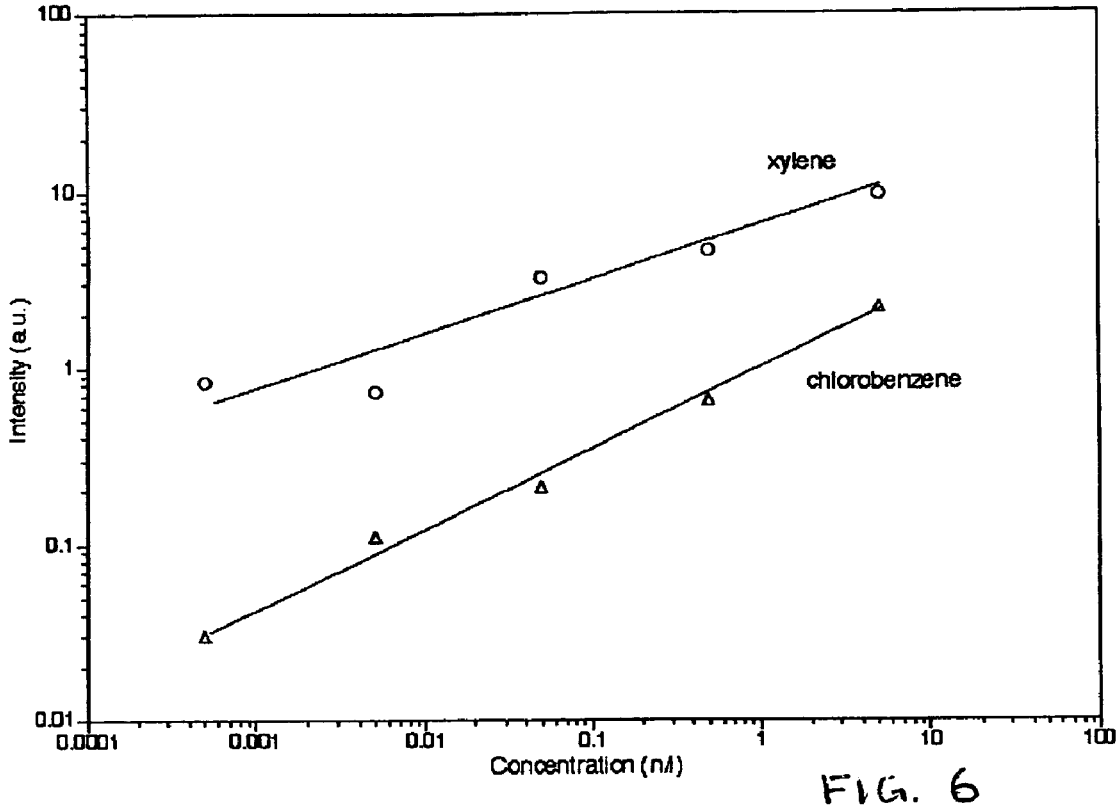
FIG. 6 is a graph of the measured intensity signals as a function of concentration for the analytes xylene and chlorobenzene.

For the LOD determinations, 10 mL injections were made using the five sample concentrations noted above. Averaging time was increased to 5 s to improve the statistics. Typical results are shown in FIG. 6 for o-xylene and chlorobenzene. A high degree of linearity is observed over four orders of magnitude in analyte concentration. Based on these tests, LODs were estimated for several aromatic compounds as given in Table 3. These limits were obtained by extrapolating the measured signals down to a signal-to-noise ratio of unity. Measurements in the ppt range can be made very rapidly (5 s). With further averaging to reduce statistical noise, the same LODs could be obtained at a S/N=3:1.

TABLE 3

Limits of detection for benzene, xylene, and chlorobenzene based on measured signals (5s integration) as a function of concentration extrapolated to S/N = 1:1.

| Compound | Extrapolated Limit of Detection at a S/N = 1:1 |
|---|---|
| Benzene | 0.1 pL/L (100 ppq) |
| Xylene | 30 fL/L (30 ppq) |
| Chlorobenzene | 1.0 pL/L (1 ppt) |

These results show that the advantages of laser photoionization detection include the speed of response and high sensitivity with good chemical selectivity. There is no need to deconvolute mass peaks either experimentally or mathematically because the parent ion peak is directly proportional to the absolute analyte concentration. Variants of the fixed wavelength REMPI photoionization scheme can also be employed. Using a jet inlet to entrain and cool the VOCs in a supersonic flow and a narrow-band tunable laser increases both the sensitivity and selectivity of the system (e.g., easily distinguishing ethylbenzene and the three xylene isomers), but at the expense of added complexity owing to the tunable laser source and pulsed inlet valve. To make a single photon laser, the initial 1.064 μm Nd:YAG fundamental frequency can be tripled to 355 nm using nonlinear, solid state crystals, and then tripled again in a gas cell containing Ar and Xe to produce 118 nm photons. These 10.5 eV photons are capable of directly ionizing many VOCs, again producing the parent ion with no fragmentation. This renders accessible many other important, but non-aromatic VOCs such as chloroform and trichloroethylene that are important in environmental problems involving ground water contamination.

What is claimed is:

1. An apparatus for identifying analytes at low concentration in a liquid sample comprising a solvent and said analytes by mass spectrometry comprising:

a zone of ionization for ionizing gaseous or liquid analytes;

a membrane impermeable to solvent and permeable to at least a portion of the amount of said analytes contained in said liquid sample, whereby said permeable analytes are deliverable to said zone of ionization;

a capillary tube adapted for receiving the portion of said liquid sample impermeable to said membrane containing other analytes not retained on said membrane, said tube directed to introduce said liquid sample and other analytes from said membrane to said zone of ionization;

a first source for providing radiation for performing resonance enhanced multiphoton ionization of said analytes;

a second source for providing radiation for performing single photon ionization of said analytes;

a system of reflecting surfaces for selectively directing radiation either from said first source or said second source to said zone of ionization; and a mass spectrometer for determining the m/e ratio of ions formed in said zone.

2. The apparatus according to claim 1 wherein said first source comprises a laser.

3. The apparatus according to claim 1 wherein said second source comprises a laser.

4. The apparatus according to claim 1 wherein said first and second source are the same source.

5. The apparatus according to claim 1 said first source and said second source are different sources.

6. An apparatus according to claim 1 further comprising means for driving analytes initially retained on said membrane through said membrane into said zone of ionization.

7. An apparatus for photoionizing analytes for analysis by mass spectrometry comprising:

a) a zone of photoionization for ionizing gaseous or liquid analytes;

b) a first source for providing radiation for performing resonance enhanced multiphoton ionization of said analytes;

c) a second source for providing radiation for performing single photon ionization of said analytes; and d) a system of reflecting surfaces for selectively directing radiation either from said first source or said second source to said zone of photoionization.

8. The apparatus according to claim 7 wherein said first source comprises a laser.

9. The apparatus according to claim 7 wherein said second source comprises a laser.

10. The apparatus according to claim 7 wherein said first and second source are the same source.

11. The apparatus according to claim 7 said first source and said second source are different sources.

12. The apparatus according to claim 1 or 7 wherein said system of reflecting surfaces includes a path for tuning radiation from said first source to result in radiation suitable for performing resonance enhanced multiphoton ionization.

13. The apparatus according to claim 1 or 7 wherein said system of reflecting surfaces includes a path for tuning radiation from said second source to result in radiation suitable for performing single photon ionization.

14. An apparatus according to claim 1 or 7 wherein said first source provides radiation at 266 nm.

15. An apparatus according to claim 1 or 7 wherein said second source provides radiation at 118 nm.

16. An apparatus for identifying an analyte at low concentration in a liquid sample comprising a solvent and said analyte by mass spectrometry comprising;

a membrane impermeable to said solvent and permeable to at least a portion of the amount of said analyte in said sample;

a zone of photoionization for analyte passing through said membrane;

a source for irradiating said zone for performing resonance enhanced multiphoton ionization at 266 nm of said analyte; and a mass spectrometer for determining the m/e ratio of ions formed in said zone.

17. An apparatus for introducing analytes from a liquid sample into an ionization zone for analysis by mass spectrometry comprising:

a membrane impermeable to the solvent of said sample and permeable to at least a portion of the analytes contained in said sample, said permeable analytes being capable of delivered to a zone of ionization; and a capillary tube adapted for receiving the portion of said liquid sample impermeable to said membrane containing other analytes not retained on said membrane, said tube capable of introducing said liquid sample and other analytes from said membrane to said zone of ionization.

18. The apparatus according to claim 17 further comprising a differential pump to drive a portion of said sample out of said apparatus and a portion of said sample to said capillary tube.

19. The apparatus according to claim 1, 16 or 17 further comprising a guide for directing said permeable analytes to said zone of ionization.

20. A method for identifying analytes at low concentration in a liquid sample by mass spectrometry comprising the steps of:

a) introducing a liquid sample containing a solvent and said analytes to a membrane impermeable to said solvent whereby at least a portion of said analytes permeate said membrane;

b) directing said analytes that permeate said membrane into a zone of photoionization in which said analytes are ionized by resonance enhanced multiphoton ionization or by single photon ionization to form analyte ions;

c) passing said analyte ions from step (b) into a mass analyzer of a mass spectrometer for mass analysis of said ions;

d) directing the portion of said liquid sample impermeable to said membrane containing other analytes not retained on said membrane into a capillary tube whereby said liquid sample and other analytes from said membrane are introduced to said zone of ionization;

e) ionizing said other analytes from step (d) by resonance enhanced multiphoton ionization or by single photon ionization to form analyte ions;

f) passing said analyte ions from step (e) into said mass analyzer of said mass spectrometer for mass analysis of said ions;

g) optionally, applying heat to said membrane to drive any analytes retained on said membrane through said membrane into said zone of photoionization in which said analytes are ionized by resonance enhanced multiphoton ionization or by single photon ionization to form analyte ions; and h) optionally, passing said analyte ions from step (g) into said mass analyzer of said mass spectrometer for mass analysis of said ions.

21. A method for identifying analytes at low concentration in a liquid sample by mass spectrometry comprising the steps of:

a) introducing a liquid sample containing a solvent and an analyte to a membrane impermeable to said solvent whereby at least a portion of the amount said analyte in said sample permeates said membrane;

b) directing said analyte that permeates said membrane into a zone of photoionization in which said analyte is ionized by resonance enhanced multiphoton ionization at 266 nm to form analyte ions; and c) passing said analyte ions into a mass analyzer of a mass spectrometer for mass analysis of said ions.

22. The method according to claim 20 or 21 wherein said solvent is polar.

23. The method according to claim 20 or 21 wherein said analytes comprises an organic compound.

24. The method according to claim 20 or 21 wherein said analytes comprise and inorganic compound.

25. The method according to claim 20 or 21 wherein the concentration of said analytes in said sample are within the range of about 1 ppb to about 1 ppt.

26. The method according to claim 25 wherein the concentration of said analytes in said sample are within the range of about 1 ppb to about 1 ppm.

27. The method according to claim 20 or 21 wherein said liquid sample comprises ultrapure water containing trace organic compounds.

28. The method according to claim 27 wherein said ultrapure water is for use in processing semiconductor products, pharmaceuticals, biotechnology products, optoelectronic products, foods or beverages.

29. The method according to claim 27 wherein said ultrapure water is for use in steam generation.

30. The method according to claim 20 or 21 wherein liquid sample comprises groundwater, municipal water or potable water.

31. A method according to claim 20 or 21 wherein said liquid sample comprises a biological fluid.

32. A method according to claim 20 wherein said resonance enhanced multiphoton photoioization is performed with 266 nm radiation.

33. A method according to claim 20 wherein said single photon ioization is performed with 118 nm radiation.

* * * * *

UNITED STATES PATENT AND TRADEMARK OFFICE

CERTIFICATE OF CORRECTION

PATENT NO. : 7,161,145 B2
APPLICATION NO. : 11/111491
DATED : January 9, 2007
INVENTOR(S) : Harald Oser et al.

It is certified that error appears in the above-identified patent and that said Letters Patent is hereby corrected as shown below:

In Column 13, Line 28, Claim 24 delete the word "and" and replace it with --an--.

Signed and Sealed this

First Day of July, 2008

JON W. DUDAS
*Director of the United States Patent and Trademark Office*